US006798149B2

(12) United States Patent
Yonezawa et al.

(10) Patent No.: US 6,798,149 B2
(45) Date of Patent: Sep. 28, 2004

(54) FLUORESCENT LUMINOUS TUBE AND METHOD FOR PRODUCING SAME

(75) Inventors: Yoshihisa Yonezawa, Mobara (JP); Hiroyuki Suzuki, Mobara (JP); Katsutoshi Iida, Mobara (JP); Yukio Ogawa, Mobara (JP)

(73) Assignee: Futaba Corporation, Chiba (JP)

( * ) Notice: Subject to any disclaimer, the term of this patent is extended or adjusted under 35 U.S.C. 154(b) by 0 days.

(21) Appl. No.: 10/376,456

(22) Filed: Mar. 3, 2003

(65) Prior Publication Data

US 2003/0164687 A1 Sep. 4, 2003

(30) Foreign Application Priority Data

Mar. 4, 2002 (JP) ..... 2002-056756

(51) Int. Cl.[7] ..... G09G 3/10

(52) U.S. Cl. ..... 315/169.3; 315/169.1; 313/496

(58) Field of Search ..... 445/26, 24, 25; 315/169.3, 169.1; 313/495, 496, 631, 632, 107.5; G09G 3/10

(56) References Cited

U.S. PATENT DOCUMENTS 6,312,302 B1 * 11/2001 Na ..... 445/24
2001/0008361 A1 * 7/2001 Ogawa et al. ..... 313/492

FOREIGN PATENT DOCUMENTS

JP 2-123649 A * 5/1990 ..... H01J/31/15

* cited by examiner

*Primary Examiner*—Don Wong
*Assistant Examiner*—Trinh Vo Dinh
(74) *Attorney, Agent, or Firm*—Bacon & Thomas

(57) ABSTRACT

A fluorescent luminous device includes a substrate, a plurality of anode electrodes disposed directly on the substrate, fluorescent layers disposed on the anode electrodes, a multiplicity of separators disposed on the fluorescent layers and the substrate, grid electrodes respectively disposed on the separators to form a matrix structure, and an electron-emitting source spaced apart from the fluorescent layers for exciting a fluorescent substance of the fluorescent layers. The fluorescent layer is of a stripe pattern or an array of fluorescent dots. In the latter case, at least a part of each of two neighboring separators is located on one fluorescent dot.

6 Claims, 9 Drawing Sheets

FLUORESCENT LUMINOUS TUBE AND METHOD FOR PRODUCING SAME

FIELD OF THE INVENTION

The present invention relates to a fluorescent luminous tube and a fabricating method thereof, wherein the fluorescent luminous tube has anode electrodes and grid electrodes arranged in a matrix form, the grid electrodes being formed on insulating separators.

BACKGROUND OF THE INVENTION

FIGS. 6A to 6C illustrate a graphic fluorescent display tube which is a type of prior art fluorescent luminous tubes, wherein FIG. 6A shows a plan view thereof; FIG. 6B, a cross-sectional view taken along a line "Y1—Y1" of FIG. 6A; and FIG. 6C, an expanded view of a portion of FIG. 6B.

The prior art graphic fluorescent display tube includes an anode substrate 51 made of glass, filaments 61, each serving as a cathode, an anchor 62 for applying tension to the filaments 61, a supporting member 63 for supporting the filaments 61, an insulating layer 64, anode electrodes 71, fluorescent layers 72, separators 73 made of an insulating material, metal layers 74, and wire grid electrodes 75. The anode electrodes 71 and the wire grid electrodes 75 are arranged in a matrix form.

The fluorescent layers 72 of a dot array shape are disposed on the anode electrodes 71. The wire grid electrodes 75 are securely formed on the metal layers 74 disposed on the separators 73. Each of the separators 73 is formed to have a predetermined height by repeatedly printing an insulative paste on the anode electrodes 71 and, further, on the anode substrate 51 (between adjacent anode electrodes 71). See, e.g., Japanese Patent Laid-Open Publication No. 1990-123649.

In FIG. 6, the dots of the fluorescent layer 72 are precisely arranged on the anode electrode 71 with a predetermined size and interval and the separators 73 are actually aligned between adjacent fluorescent dots in a direction perpendicular to the length of the anode electrodes 71.

FIG. 7 illustrates a plan view of the anode substrate 51 to describe a case of misalignment of the separators 73. The filaments 61, the anchor 62, the supporting member 63, the metal layers 74, and the wire grid electrodes 75 are omitted therein for the sake of simplicity.

If the separators 73 are misaligned, for example, to positions 73' shown in FIG. 7, each dot of the fluorescent layer 72 is partially buried thereby, so that a luminous area of the fluorescent layers 72 is reduced below a designed specification and the display quality is deteriorated. Accordingly, a printing mask used for forming the separators 73 should be very accurately aligned with respect to the fluorescent layers 72.

As previously explained, the separators 73 are formed by repeatedly printing the insulative paste to be sequentially laminated on the anode electrodes 71 and on the anode substrate 51 (between adjacent anode electrodes 71). Since, however, the insulative paste has a certain degree of fluidity, a first or a bottom paste layer of each separator 73 spreads over the anode electrodes 71 and the anode substrate 51, thereby generating a broadened portion 731 at the bottom thereof, as shown in FIG. 6C. Though the amount of spread depends on the paste employed, the broaden portion 731 normally enlarges a width of the separator 73 by about 50%.

Accordingly, a precise estimation of the size of the broadened portion 731 and an accurate alignment of the printing mask are needed in forming the separators 73. These requirements make it difficult to properly form the separators 73 and thus lower the yield of the fluorescent luminous tube. Therefore, a costly printing apparatus capable of performing a highly accurate alignment is required in forming the separators.

Furthermore, the broadened portion 731 makes it difficult to reduce an interval of the separators 73 because a large portion of the interval between adjacent separators 73 is wasted by the broadened portion 731; and therefor, the interval may be set with a greater design margin to prevent the dots of the fluorescent layer 72 from being buried thereby. For these reasons, it is very difficult to produce a high-resolution display by using a prior art fluorescent luminous tube.

SUMMARY OF THE INVENTION

It is, therefore, an object of the present invention to provide a fluorescent luminous tube, e.g., a fluorescent display tube and the like, and a method for production thereof, wherein the generation of broadened portions of separators can be avoided on fluorescent layers even when the separators are misaligned, thereby producing a high-resolution display.

In accordance with one aspect of the present invention, there is provided a fluorescent luminous device including: a substrate; a plurality of anode electrodes disposed directly on the substrate; fluorescent layers of a stripe pattern disposed on the anode electrodes; a multiplicity of separators disposed on the fluorescent layers and the substrate; grid electrodes respectively disposed on the separators, wherein the grid electrodes and the anode electrodes are arranged to form a matrix structure; and an electron-emitting source spaced apart from the fluorescent layers for exciting a fluorescent substance of the fluorescent layers.

In accordance with another aspect of the present invention, there is provided a fluorescent display device including: a substrate; a plurality of anode electrodes disposed directly on the substrate; an array of fluorescent dots disposed on the anode electrodes; a plurality of separators disposed on the fluorescent dots and the substrate, wherein at least a part of each of two neighboring separators is located on one fluorescent dot; grid electrodes respectively disposed on the separators, wherein the grid electrodes and the anode electrodes are arranged to form a matrix structure; and an electron-emitting source spaced apart from the fluorescent dots for exciting a fluorescent substance of the fluorescent dots.

In accordance with still another aspect of the present invention, there is provided a method for producing an anode substrate for use in a fluorescent luminous tube, including the steps of: forming anode electrodes directly on a bare anode substrate; forming fluorescent layers of a stripe pattern or a dot array pattern on the anode electrodes;

forming separators on the fluorescent layers and exposed portions of the bare substrate such that the separators are arranged across the anode electrodes; forming grid electrodes on the separators to form a semifinished substrate; and baking the semifinished substrate.

BRIEF DESCRIPTION OF THE DRAWINGS

The above and other objects and features of the present invention will become apparent from the following description of preferred embodiments given in conjunction with the accompanying drawings, in which:

FIGS. 1A to 1C illustrate various views of a graphic fluorescent display tube in accordance with a first preferred embodiment of the present invention, wherein FIG. 1C is a cross-sectional view taken along a line "X1—X1" in FIGS. 1A and 1B, which are plan views taken along a line "X2—X2", respectively, in the directions of arrows "a" and "b" in FIG. 1C;

FIGS. 6A to 6C set forth a prior art graphic fluorescent display tube which is a type of fluorescent luminous tubes, wherein FIG. 6A shows a plan view thereof; FIG. 6B, a cross-sectional view taken along a line "Y1—Y1" of FIG. 6A; and FIG. 6C, an expanded view of a portion of FIG. 6B.

DETAILED DESCRIPTION OF THE PREFERRED EMBODIMENT

Figure 1A:
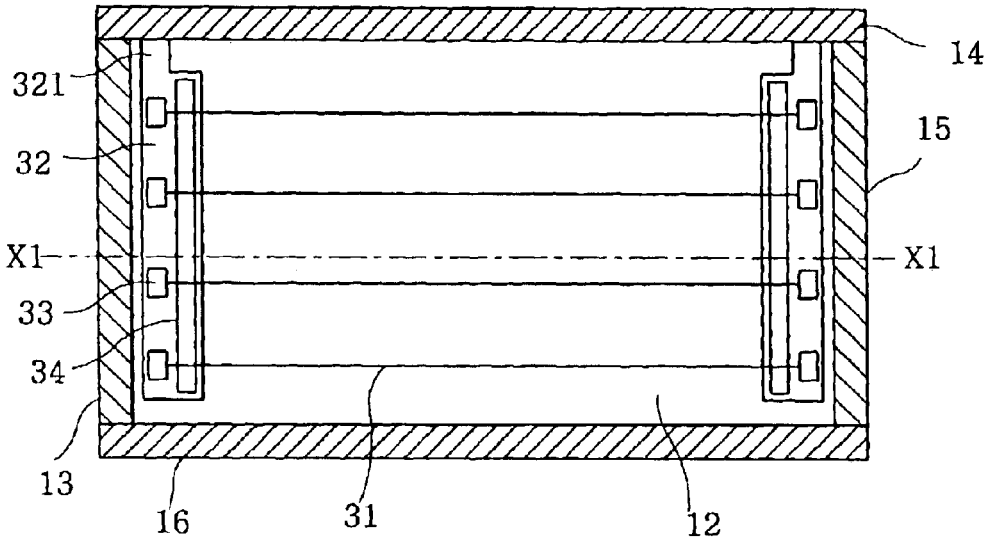

Referring now to FIGS. 1A to 5, a graphic fluorescent display tube and a method for production thereof in accordance with preferred embodiments of the present invention will be described in detail. Like numerals represent like parts in the drawings.

Figure 1B:
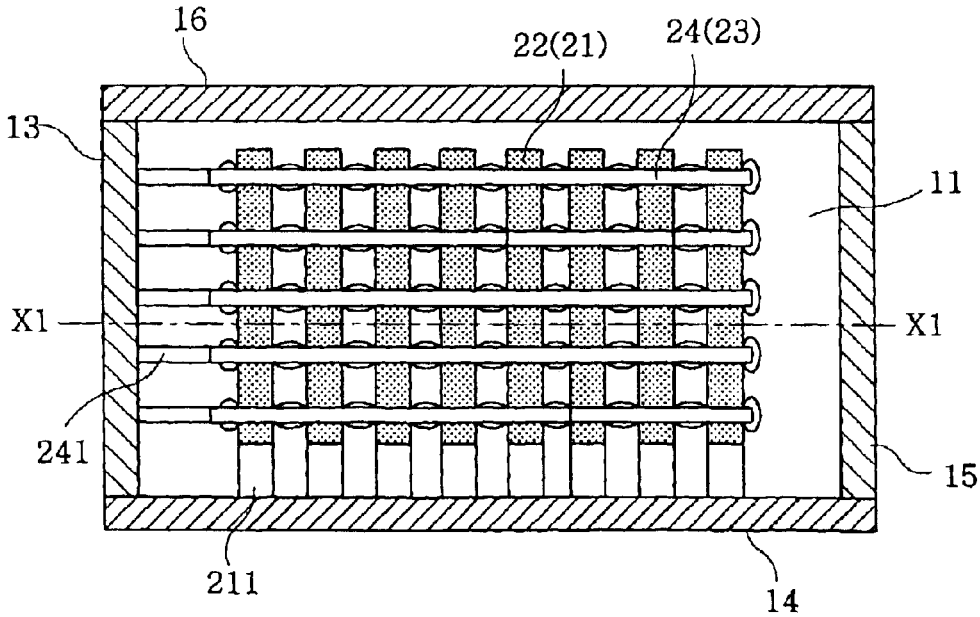
Figure 1C:
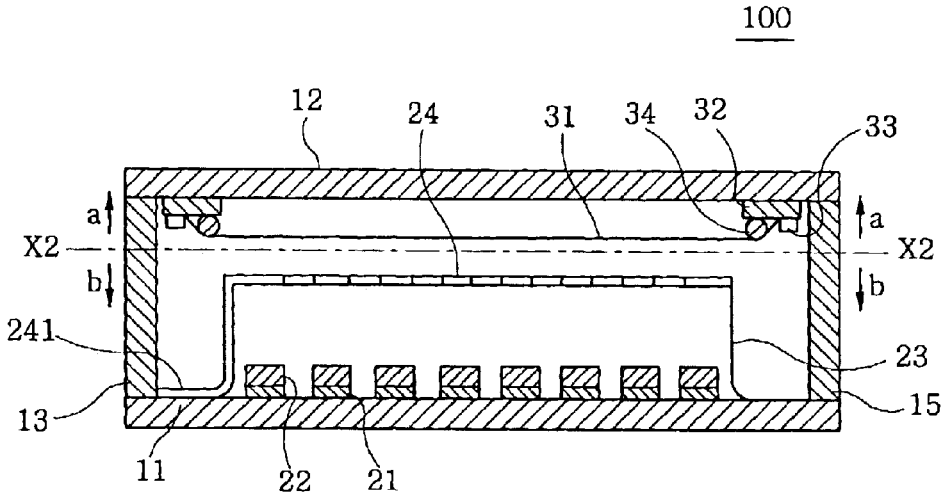
Figure 2A:
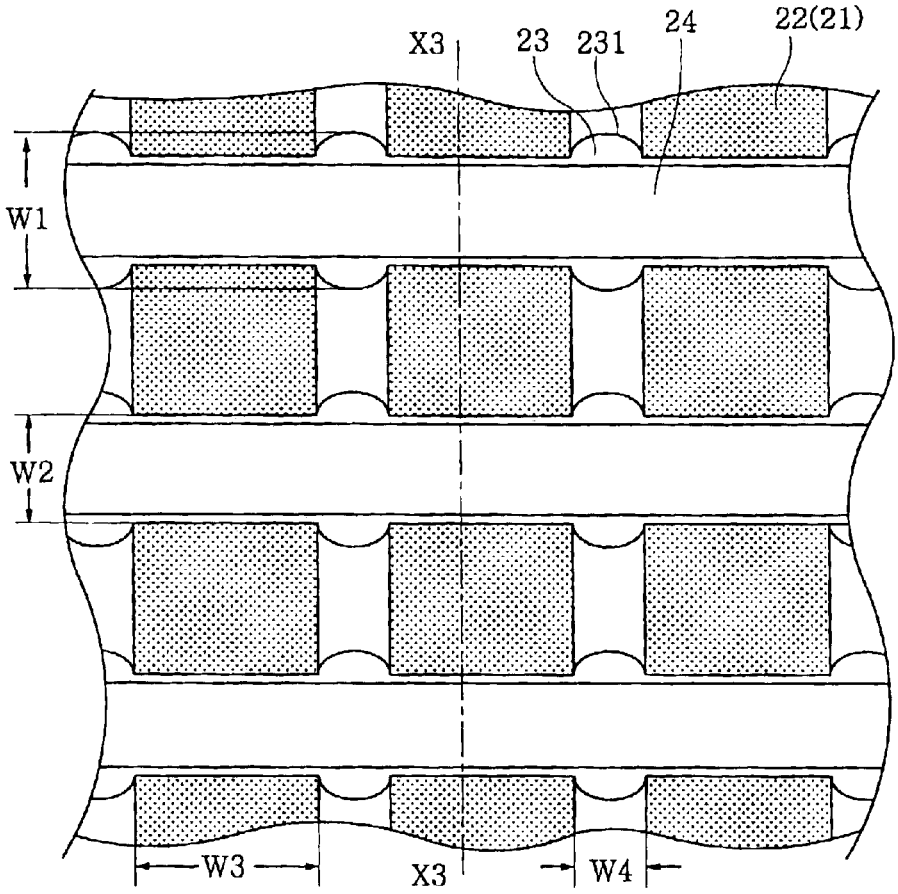
FIG. 2A provides a partial expanded view of FIG. 1B.
Figure 2B:
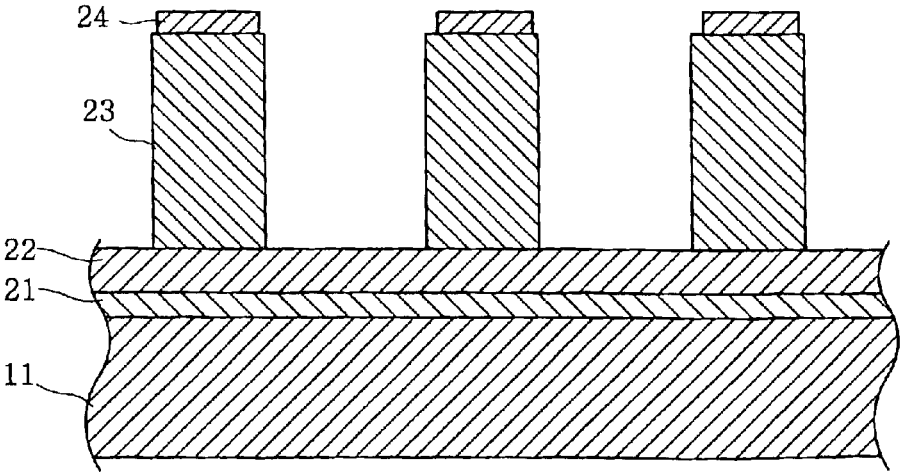
FIG. 2B gives a cross-sectional view taken along a line "X3—X3" in FIG. 2A.

FIGS. 1A to 1C, FIGS. 2A and 2B are respectively plan views and sectional views of a graphic fluorescent display tube 100 in accordance with a first preferred embodiment of the present invention. FIG. 1C is a cross-sectional view taken along a line "X1—X1" in FIGS. 1A and 1B, which are plan views taken along a line "X2—X2", respectively, in directions of arrows "a" and "b" in FIG. 1C. FIG. 2A provides a partial expanded view of FIG. 1B and FIG. 2B gives a cross-sectional view taken along a line "X3—X3" in FIG. 2A.

The graphic fluorescent display tube 100 in accordance with the first preferred embodiment of the present invention includes sidewalls 13 to 16, an anode substrate 11, and a front substrate 12, each being made of an insulating material such as glass or ceramic.

Disposed on an inner surface of the anode substrate 11 is a multiplicity of anode electrodes 21 made of a conductive layer, such as indium tin oxide (ITO) or aluminum (Al), in the form of a stripe pattern. A reference numeral 211 represents a distribution wiring portion made of a conductive layer of, e.g., ITO or Al. Disposed on each of the anode electrodes 21 is a fluorescent layer 22 made of, for example, ZnO:Zn in the form of a stripe pattern. Disposed across the anode electrodes 21 are a plurality of separators 23 made of an insulating material in the form of a stripe pattern. Respectively disposed on each of the separators 23 is a grid electrode 24 made of a conductive layer such as aluminum in the form of a stripe pattern. Each of the grid electrodes 24 is connected to a distribution wiring portion 241, which is made of a conductive layer such as aluminum of the grid electrode 24.

Disposed under an inner surface of the front substrate 12 are a plural number of filaments 31, each serving as a cathode, that is an electron-emitting source to excite a fluorescent substance of the fluorescent layer 22. Each of the filaments 31 is made by coating an electron-emitting material, e.g., ternary carbonate, on a core wire made of, e.g., tungsten or tungsten alloy.

Each of the filaments 31 is electrically connected between a pair of cathode electrodes 32 made of a conductive layer such as aluminum. Each of the cathode electrodes 32 is electrically connected to a distribution wiring portion 321 made of a conductive layer of Al in the cathode electrode 32. Each end portion of the filaments 31 is fixedly attached to a corresponding cathode electrode 32 through the use of a metallic segment 33 made of aluminum by ultrasonic welding, preferably. A reference numeral 34 represents filament spacers made of glass fibers or wire-shaped conductors.

The anode electrodes 21 and the grid electrodes 24 are arranged in the form of a matrix (including an oblique or orthogonal arrangement).

The anode substrate 11, the front substrate 12, and the sidewalls 13 to 16 are assembled together by using sealant such as glass frit to form a hermetically sealed envelope, which is then evacuated.

If the fluorescent layers 22 are to be displayed through the anode substrate 11, a transparent material such as glass (having light-transmitting property) is to be used to make the anode substrate 11, and the anode electrodes 21 need to be made of a transparent conductive material such as ITO or alternatively may be of a light-transmitting structure such as a mesh made of an opaque conductive material, for example, Al. On the contrary, if the fluorescent layers 22 are to be viewed through the front substrate 12, a transparent material such as glass is used to make the front substrate 12.

After each of the anode electrodes 21 is directly formed on the anode substrate 11 (i.e., without any other part engaged therebetween), a fluorescent layer 22 having a thickness of about 10 to about 30 $\mu$m on each of the anode electrode 21 is formed through the use of a photolithographical process. Herein, the fluorescent layer 22 is made dry after the photolithographical process and, therefore, can readily absorb solvent contained in a paste used to form the separator 23, as will be explained later.

Each of the separators 23 is formed on the fluorescent layer 22 and, further, on the anode substrate 11 (between adjacent anode electrodes 21). In detail, a printing paste is repeatedly laminated thereon about ten times by applying a screen-printing method using a mask that has openings suitable for forming the separators 23, wherein the printing paste may be made by mixing frit glass (insulating material) and vehicle (solvent). The solvent may be composed of cellulose dissolved in terpineol.

To form a grid electrode 24 on a separator 23, a conductive paste is repeatedly laminated thereon about two times by applying a screen-printing method using a mask that has openings suitable for forming the grid electrode 24. A combined height of a separator 23 and a grid electrode 24 thereon is about 100 $\mu$m.

A first or a bottom paste layer of a separator 23 is printed directly on the corresponding fluorescent layer 22 and the anode substrate 11. Since the anode substrate 11 rarely absorbs the solvent of the separator 23, the paste of the separator 23 spreads over the anode substrate 11 to form a broadened portion 231. On the contrary, the fluorescent layer 22 (capable of absorbing the solvent) absorbs the solvent of the separators 23 and, therefore, the paste is hardened before being spread on the fluorescent layers 22.

Though a florescent layer 22 has a relatively low adhesion strength with respect to a separator 23 because of its own granular nature, the adhesivity between a separator 23 and the anode substrate 11 is fairly good. Therefore, the broadened portions 231 (having a greater width) effectively increase the adhesion strength between the separators 23 and the anode substrate 11.

When the opening portion of the mask used in forming a separator 23 in the first preferred embodiment has a width of about 100 $\mu$m, each of the broadened portions 231 of the separators 23 is formed with a first width "W1" of about 150 $\mu$m on the anode substrate 11 and a second width of about 100 $\mu$m on the fluorescent layer 22. That is to say, the separator 23 hardly spreads on the fluorescent layer 22 and therefore can be formed to have almost a same width as that of the opening portions of the mask employed. Further, the printing paste of the broadened portion 231 spreads along boundaries between the fluorescent layers 22 and the anode substrate 11 and, therefore, rarely covers the fluorescent layers 22.

After the first or the bottom paste layer of the separator 23 is completed, the printing process is repeated by using the same mask to form a second to a last paste layer, which is a top paste layer, of the separator 23. Herein, since each of the second to the last layer of the separator 23 is formed on a previously formed paste layer, the solvent is absorbed by the previously formed paste layer, thereby preventing the spreading of the printing paste. Accordingly, each of the second to the last paste layer can be formed to have almost a same width as that of the opening portions of the mask.

Each of the anode electrodes 21 (as well as the fluorescent layers 22) has a width "W3" of about 260 $\mu$m and a pitch (or an interval) "W4" of about 30 $\mu$m.

Though FIG. 1 illustrates a configuration in which the filaments 31 are mounted on the front substrate 12, the filaments 31 may be alternatively mounted on the anode substrate 11. For the latter configuration, after an insulating layer (not shown) is formed on the distribution wiring portion 211 of the anode electrode 21 or the distribution wiring portion 241 of the grid electrode 24, the cathode electrode 32 is formed on the insulating layer.

Figure 3:
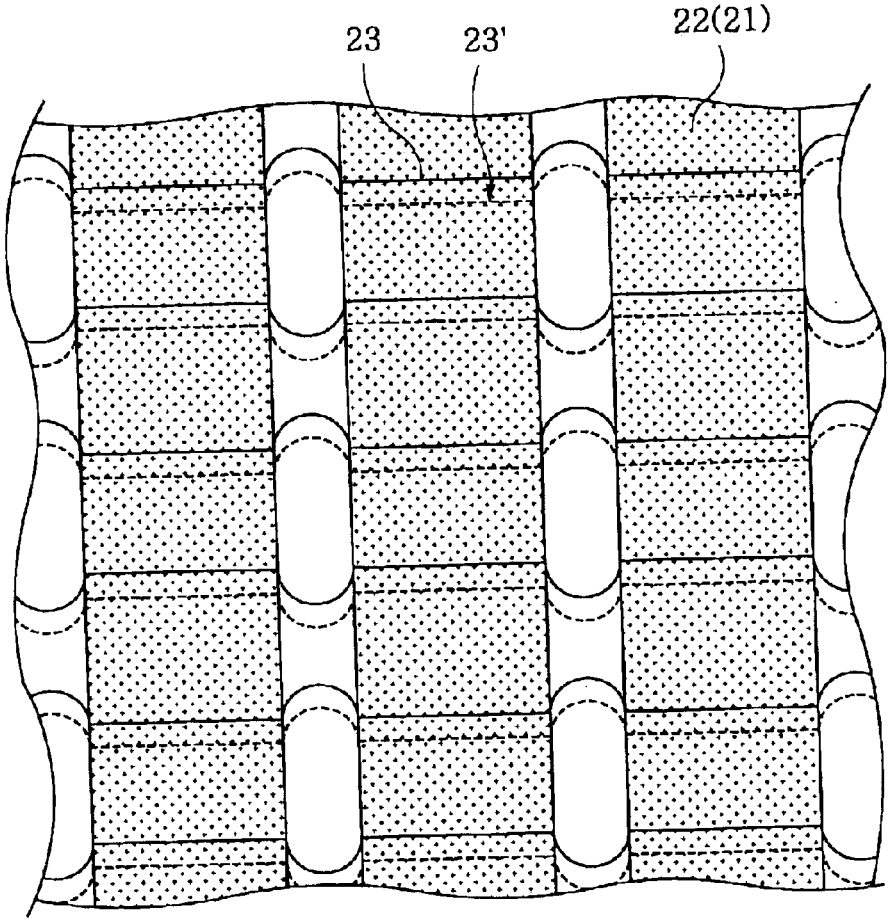
FIG. 3 shows a partial expanded plan view of FIG. 1B to describe a case of misalignment of separators.

Referring to FIG. 3, a misalignment of the separators 23 in the first preferred embodiment will be explained.

Each of the fluorescent layers 22 of the stripe pattern is partially exposed through a spacing between adjacent separators 23 and only the exposed portions thereof are luminous. Therefore, the size of luminous area of the fluorescent layers 22 is determined (i.e., self-aligned) by a pitch of the separators 23 and the width "W3" of the fluorescent layers 22.

If the mask is displaced from a desired position during the screen-printing process, the separators 23 may be formed at misaligned positions 23'. Since, however, the fluorescent layers 22 are of the stripe pattern, the fluorescent layers 22 can always provide luminous area of a constant size regardless of the misalignment of the separators 23. That is to say, the misalignment of the separators 23 makes no change in the size of the displayable area on the fluorescent layer 22 exposed between adjacent separators 23 and therefore rarely affects the display quality of the graphic fluorescent display tube in accordance with the first preferred embodiment of the present invention. Consequently, the alignment margin of the mask can be more loosely set in comparison to the prior art case and, therefore, the process for forming the separators can be more easily performed.

Further, because the separators do not spread on the fluorescent layers 22 in the first preferred embodiment, the reduction in the exposed area, i.e., the luminous area of the fluorescent layers due to the broadened portion of the separators does not occur in contrast to the prior art case. Furthermore, the separators can be more densely arranged to thereby obtain a higher resolution for the same reason.

Figure 4A:
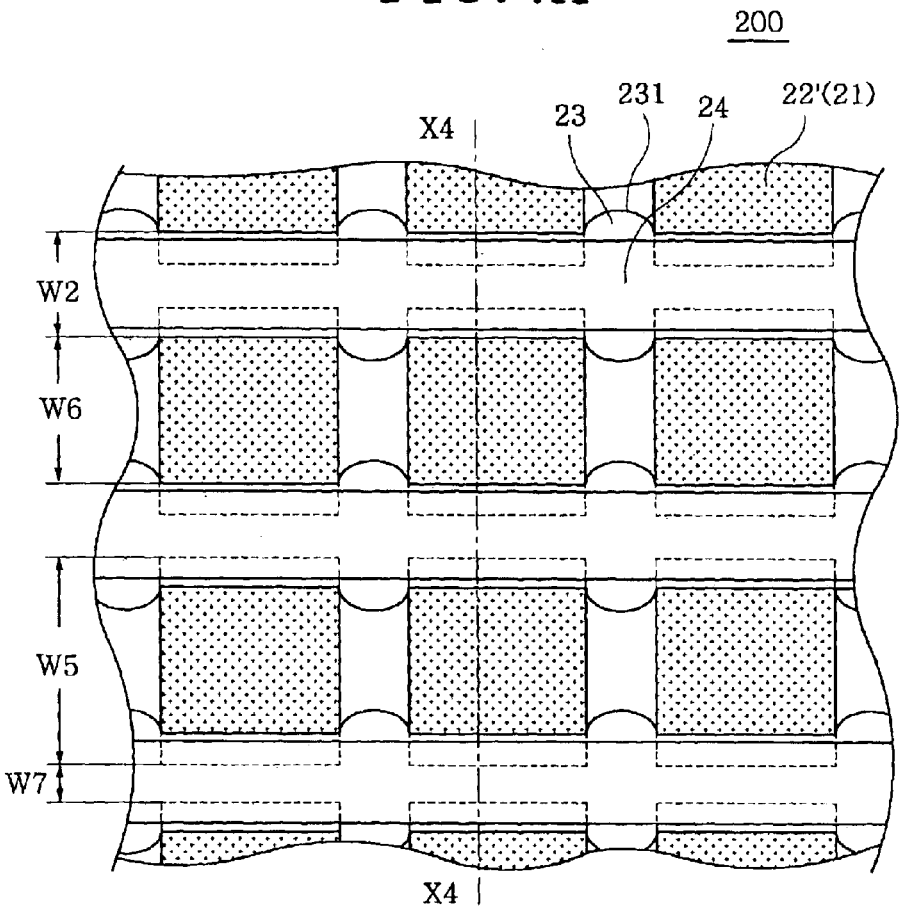
FIG. 4A offers a partial plan view of an anode substrate in accordance with a second preferred embodiment of the present invention.
Figure 4B:
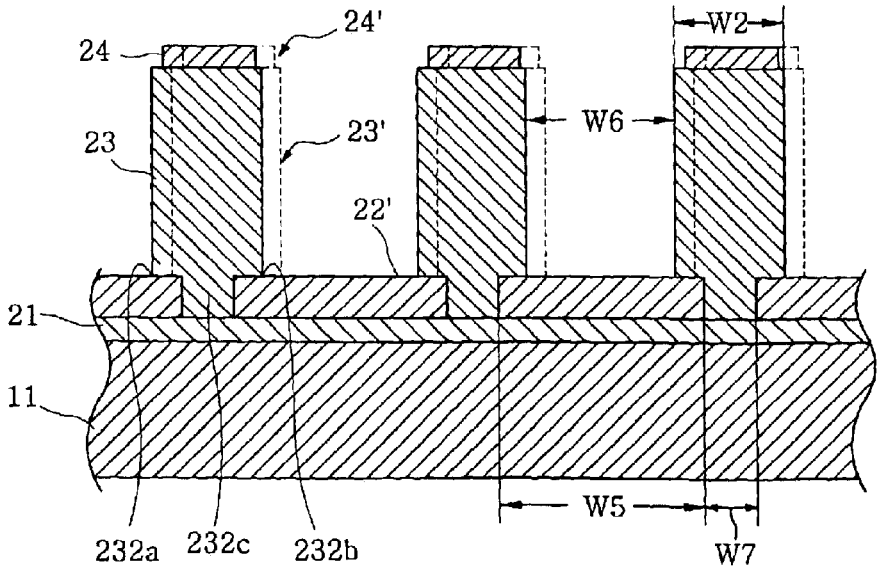
FIG. 4B depicts a cross-sectional view taken along a line "X4—X4" in FIG. 4A.

FIG. 4A offers a partial plan view of an anode substrate 200 in accordance with a second preferred embodiment of the present invention and FIG. 4B depicts a cross-sectional view taken along a line "X4—X4" in FIG. 4A.

In the anode substrate 200 shown in FIGS. 4A and 4B, an array of dot-shaped fluorescent layers 22' is disposed on anode electrodes 21 and separators 23 are disposed on the anode electrodes 21 and the fluorescent layers 22'. At each interaction region of the separators 23 and the anode electrodes 21, each of the separators 23 is formed with a first side edge 232*a*, a second side edge 232*b*, and a protruded bottom portion 232*c* located therebetween, wherein the first side edge 232*a* and the second side edge 232*b* are respectively overlapped with adjacent dots of the fluorescent layers 22' at the interaction region. Each of the fluorescent dots is prolonged along the length of the anode electrodes 21 to have an area larger than the luminous area.

If the fluorescent layers 22' are formed of the dot array shape or the like except the stripe pattern, the anode electrodes 21 can be partially exposed therethrough (such that portions thereof are not covered by the fluorescent layers 22'). The exposed surface of each of the anode electrodes 21 has a greater adhesion strength for the separators 23. Thus, such configuration, together with broadened portions 231, can further increase the adhesion strength between the separators 23 and the anode substrate 200.

In this case, a distance "W6" between two neighboring separators 23 is set to be less than a length "W5" of each dot of the fluorescent layer 22' in the length direction of the anode electrodes 21 (W6<W5) and a width "W2" of the separators 23 is set to be greater than a gap "W7" between the dots of the fluorescent layers 22' (W7<W2). Under the aforementioned condition, even if the separators 23 are misaligned to positions 23' (likewise, the grid electrodes 24 are moved to positions 24') as shown in FIG. 4B, at least a part of each of two neighboring separators 23 is always located on one dot of the fluorescent layers 22'. That is to say, because the aforementioned condition makes the fluorescent layers 22' always fill the spacing between adjacent separators 23, the size of luminous area of the fluorescent layers 22' remains constant regardless of the misalignment of the separators 23.

When the fluorescent layers 22' are of a dot array configuration having a multiplicity of polygon-shaped dots such as rectangular dots, the margin needed for aligning the separators 23 depends on the gap "W7" between the dots and, therefore, becomes smaller than that in case of the stripe patterned fluorescent layers. Nevertheless, the margin of this case is still greater than that of the prior art case that adopts a conformal dot array shape for the fluorescent layers. Further, the dot array fluorescent layers are more economical than the stripe fluorescent layers because the fluorescent substance is less consumed.

On the other hand, the stripe patterned fluorescent layer in the first preferred embodiment may be of a ladder-like configuration having multiple openings in the stripe. Such a structure may also be obtained by connecting the dots of the fluorescent layer of the second preferred embodiment in the form of a ladder.

Further, instead of making the anode substrate of a non-absorptive insulating material such as glass that does not absorb the solvent of the separator, a metal substrate having a non-absorptive insulating material formed thereon may be used as the anode substrate. Furthermore, the anode substrate may be formed of an insulating material capable of absorbing the solvent but with a non-absorptive insulating material coated thereon.

Figure 5:
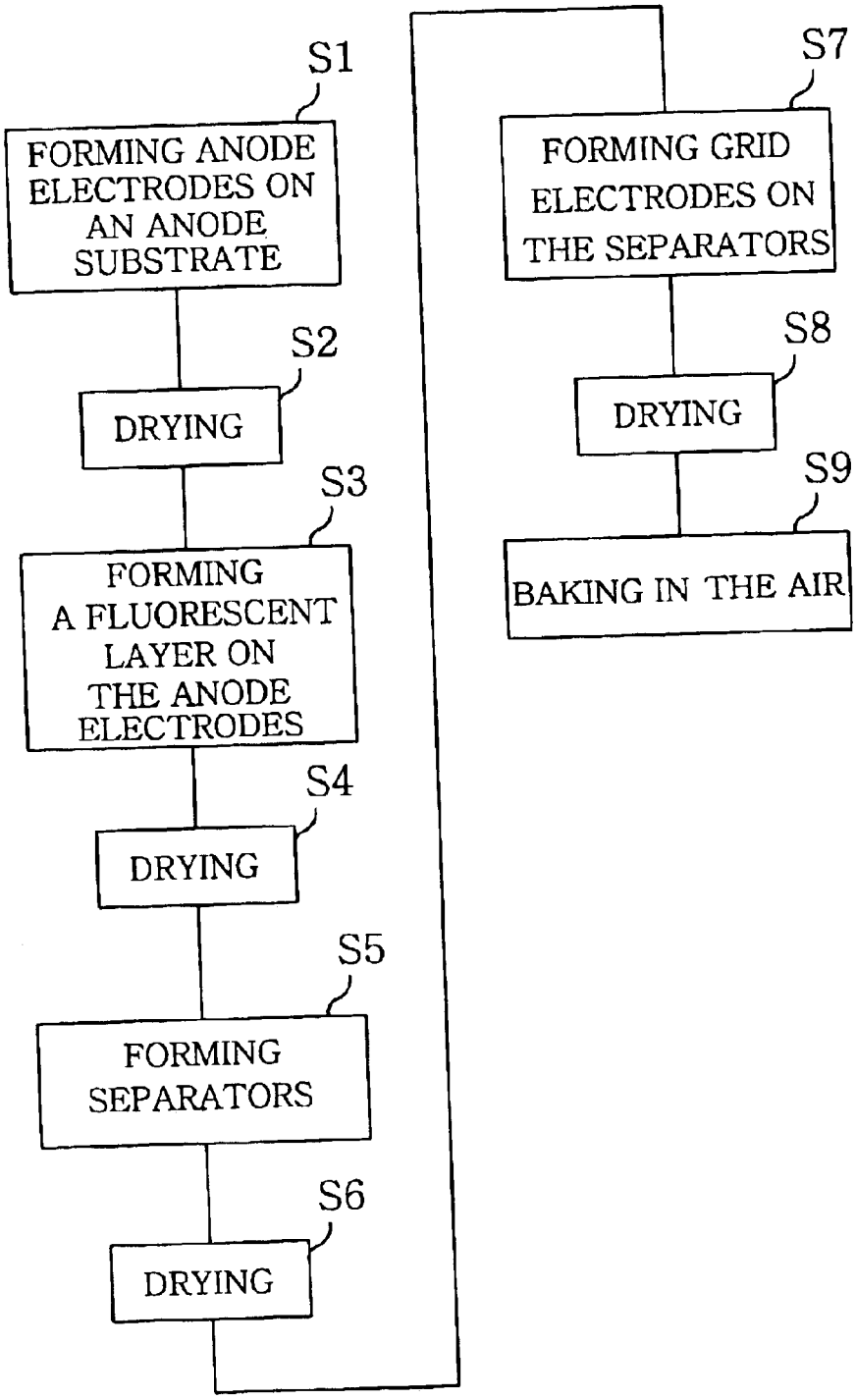
FIG. 5 is a flow chart illustrating a process for producing an anode substrate of a graphic fluorescent display tube in accordance with the preferred embodiments of the present invention.
Figure 6A:
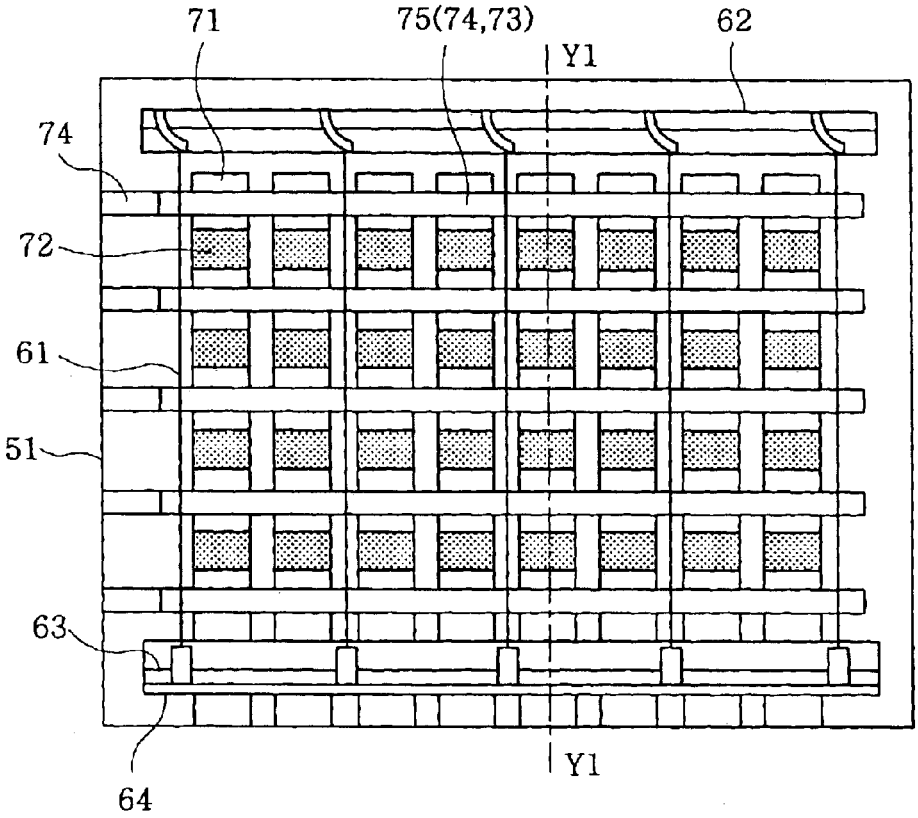
FIG. 6A (PRIOR ART)
Figure 6B:
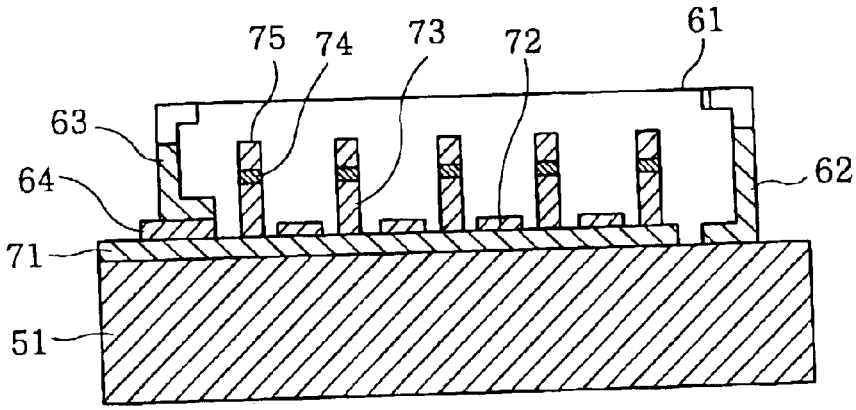
FIG. 6B (PRIOR ART)
Figure 6C:
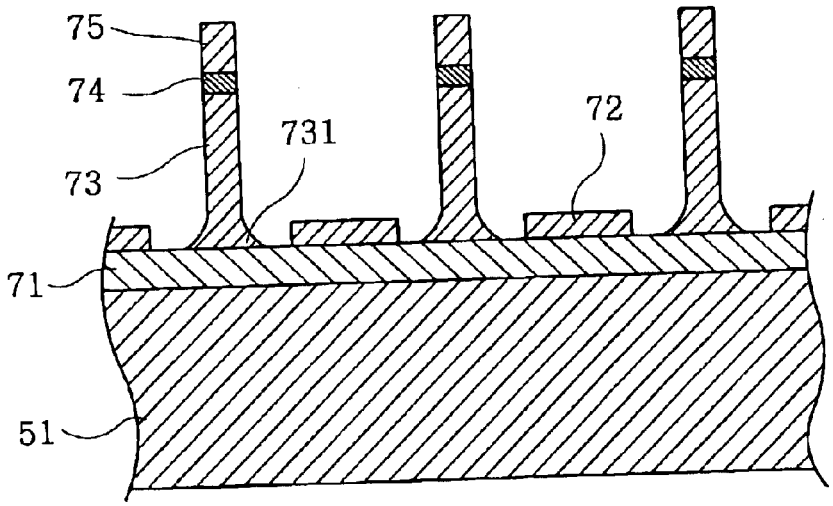
FIG. 6C (PRIOR ART)
Figure 7:
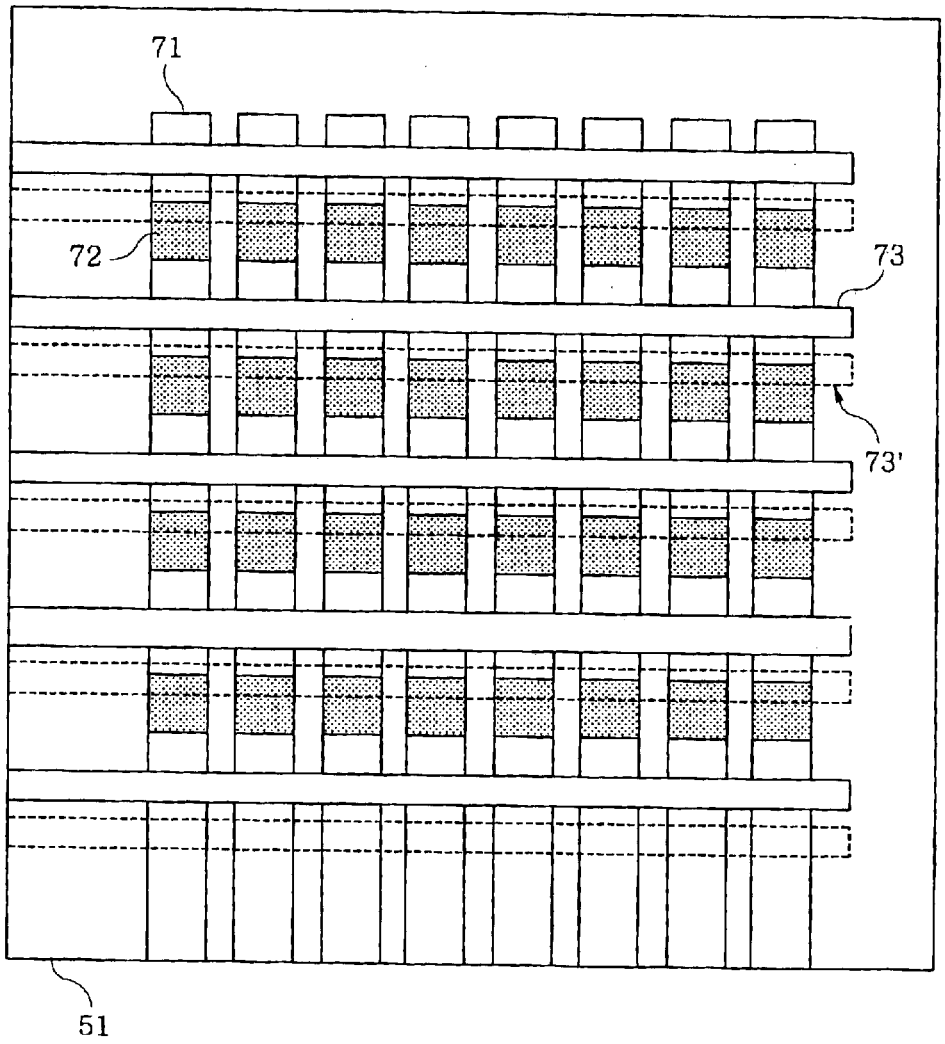
FIG. 7 (PRIOR ART)
FIG. 7 presents a schematic plan view of an anode substrate shown in FIG. 6A to describe a case of misalignment of separators of the prior art graphic fluorescent display tube.

Referring to FIG. 5, there is illustrated a process for producing the anode substrate of the graphic fluorescent display tube in accordance with the preferred embodiments of the present invention.

Anode electrodes of a stripe pattern are formed of a conductive material such as Al, ITO or the like on an anode substrate made of glass, ceramic or the like by using a screen-printing, a sputtering method or the like (step S1), and dried (step S2). The second step S2 of drying can be omitted when the sputtering is used for forming the anode electrodes. Then, fluorescent layers are formed of a stripe pattern on the anode electrodes by using a thick film photolithographical method (step S3), and dried (step S4). Then, a layer of separator is formed on the fluorescent layers and the anode substrate by using a screen-printing method, a dispenser method, an inkjet method or the like (step S5), and dried (step S6). A fifth and a sixth step S5 and S6 are alternately repeated until a last separator layer is formed. Then, grid electrodes are formed of a conductive material such as aluminum on the separators by using a screen-printing method, a dispenser method, an inkjet method or the like (step S7), and dried (step S8). Lastly, a final structure is baked in the air (step S9).

Though the preferred embodiments of the invention have been described with respect to the filament serving as a thermion emission type electron source (that is a hot cathode), a field emission cathode (that is a cold cathode) may also be alternatively adopted therefor. Further, although each of the preferred embodiments of the present invention has been described with respect to the graphic fluorescent display tube, the present invention can be equally applied to fluorescent luminous tubes for use in printers or CRTs (cathode ray tubes) adopting the principle of the fluorescent display tube.

Effects of the preferred embodiments of the present invention can be summarized as follows.

Even when the separators of the preferred embodiments of the present invention are misaligned, the fluorescent layers are present between adjacent separators without spacing between the separators and the fluorescent layers. Accordingly, the fluorescent layers always have a constant size of displayable area regardless of the misalignment of the separators. That is to say, the misalignment of the separators does not deteriorate the display quality and, therefore, the separators can be formed more easily, thereby allowing the requirement for a printing apparatus to perform a very accurate alignment of a printing mask used for forming the separators to be relaxed.

Though a very high accuracy should be applied to determine the position and the size of dots of a dot array-shaped fluorescent layers in the prior art, there is no need to achieve such a very high accuracy in the present invention because the luminous area of the fluorescent layer is determined by the interval of the separators. Further, there is no need for caring about whether the separators hide the dot array shaped fluorescent layers or not in the present invention for the same reason. Accordingly, the process of forming the separators and the fluorescent layers can be more easily performed in the present invention.

Further, because the separators are not broadened on the fluorescent layers in the preferred embodiments of the present invention, more dense arrangement of the separators can be realized, thereby enabling to obtain a display of higher resolution.

Furthermore, because the present invention applies the ultrasonic welding to directly fix the filaments to the cathode electrodes instead of using an anchor or a supporter of a complicated three dimensional structure of the prior art, the thickness of a filament supporting structure is reduced such that a thinner fluorescent luminous tube can be produced. Such a supporting structure is less expensive and even makes it simple to fix the filaments.

As explained above, the separators can be formed more easily and the fluorescent luminous tube can be produced more simply at a lower cost by the preferred embodiments of the present invention.

While the invention has been shown and described with respect to the preferred embodiment, it will be understood to those skilled in the art that various changes and modifications may be made without departing from the spirit and scope of the invention as defined in the following claims.

What is claimed is:

1. A fluorescent luminous device comprising:

a substrate;

a plurality of anode electrodes disposed directly on the substrate;

fluorescent layers of a stripe pattern disposed on the anode electrodes;

a multiplicity of separators disposed on the fluorescent layers and the substrate;

grid electrodes respectively disposed on the separators, wherein the grid electrodes and the anode electrodes are arranged to form a matrix structure; and an electron-emitting source spaced apart from the fluorescent layers for exciting a fluorescent substance of the fluorescent layers.

2. The device of claim 1, wherein each of the separators is formed of a plural number of laminated layers and at least a bottom layer thereof has a broaden portion, which is disposed directly on the substrate.

3. The device of claim 1, wherein the electron-emitting source includes at least one filament, which is attached on a cathode electrode by using an ultrasonic welding method.

4. A fluorescent display device comprising:

a substrate;

a plurality of anode electrodes disposed directly on the substrate;

an array of fluorescent dots disposed on the anode electrodes;

a plurality of separators disposed on the fluorescent dots and the substrate, wherein at least a part of each of two neighboring separators is located on one fluorescent dot;

grid electrodes respectively disposed on the separators, wherein the grid electrodes and the anode electrodes are arranged to form a matrix structure; and an electron-emitting source spaced apart from the fluorescent dots for exciting a fluorescent substance of the fluorescent dots.

5. The device of claim 4, wherein each of the separators is formed of a plural number of laminated layers and at least a layer thereof has a broadened portion, which is disposed directly on the substrate.

6. The device of claim 4, wherein the electron-emitting source includes at least one filament, which is attached on a cathode electrode by using an ultrasonic welding method.

* * * * *